United States Patent [19]

Pflieger et al.

[11] 4,153,099

[45] May 8, 1979

[54] COOLING FLUID FOR THE MANUFACTURE OF WIRE

[75] Inventors: Bernard Pflieger, Chamalieres; André Reiniche, Clermont-Ferrand, both of France

[73] Assignee: Compagnie Generale des Etablissements Michelin, Clermont-Ferrand, France

[21] Appl. No.: 842,897

[22] Filed: Oct. 17, 1977

[30] Foreign Application Priority Data

Oct. 15, 1976 [FR] France ..... 76 31802

[51] Int. Cl.[2] ..... B22D 11/00; B22D 11/124

[52] U.S. Cl. ..... 164/89; 164/423; 239/132.1

[58] Field of Search ..... 164/64, 66, 82, 89, 164/259, 415, 418, 423, 443, 444; 34/57 R, 57 E; 239/128, 132, 132.1

[56] References Cited

U.S. PATENT DOCUMENTS

| | | | |
|---|---|---|---|
| 3,543,831 | 12/1970 | Schile | 164/82 |
| 3,602,291 | 8/1971 | Pond | 164/82 |
| 3,861,452 | 1/1975 | Massoubre | 164/89 |
| 3,946,794 | 3/1976 | Rakestraw | 164/423 |

*Primary Examiner*—Othell M. Simpson
*Assistant Examiner*—K. Y. Lin
*Attorney, Agent, or Firm*—Brumbaugh, Graves, Donohue & Raymond

[57] ABSTRACT

An improved cooling fluid for an apparatus for the manufacture of a wire by projecting a jet of liquid metal or metal alloy through a nozzle into a cooling enclosure containing the cooling fluid is characterized by the fact that the cooling fluid consists of a mixture of a gas and steam, the gas and the steam being compatible with the jet, the gas furthermore being at a temperature below the condensation point of the steam, so as to transform at least a part of the steam into liquid droplets.

9 Claims, 2 Drawing Figures

COOLING FLUID FOR THE MANUFACTURE OF WIRE

Figure 1:
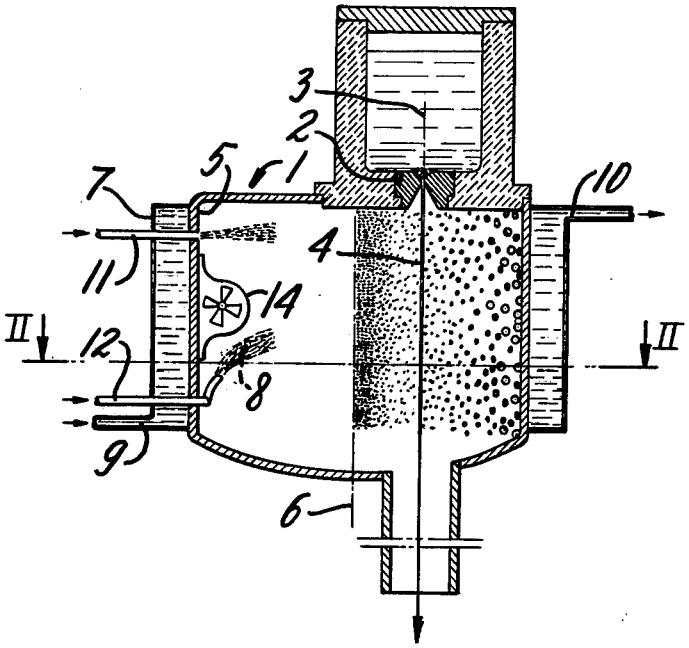

This invention relates to improvements in apparatus for the manufacture of a wire by projecting a jet of liquid metal or metal alloy into a cooling fluid in which the transformation of the liquid jet into solid wire takes place.

Such apparatus comprise a crucible containing the liquid metal or metal alloy melted by means of a heating element, and provided with at least one nozzle; means for exerting pressure on the liquid metal or metal alloy sufficient to project it in the form of a jet through the nozzle into a cooling fluid; an enclosure, referred to as the cooling enclosure, containing the cooling fluid which is capable of transforming the liquid jet into a solid wire and is arranged behind the nozzle; and a wire receiving device arranged at the outlet of the cooling enclosure.

In order to obtain a wire having satisfactory mechanical properties with such an apparatus, the jet must be projected at a relatively high speed. The resultant increase in the length of the jet up to the point where it is transformed into wire is troublesome both with respect to the dimensions of the cooling enclosure and with respect to the presence of defects and breaks of the wire.

The object of the present invention is to remedy these drawbacks by providing a cooling fluid of improved effectiveness.

Thus, the cooling fluid for use in the cooling enclosure of an apparatus of the type in question is characterized by the fact that it consists of a mixture of a gas and steam, the gas and the steam being compatible with the jet, the gas furthermore being at a temperature below the condensation point of the steam, so as to transform at least a part of the steam into liquid droplets.

By gas there is understood a gas such as hydrogen, nitrogen, argon, or helium, or a mixture of at least two of these gases, preferably hydrogen and nitrogen.

The mixture of gas and steam is preferably formed in the cooling enclosure, in order to avoid condensation in the gas feed tube. For this purpose, the gas and steam feed tubes of the cooling enclosure are spaced apart.

The increase in the effectiveness of the cooling fluid appears to be due to the formation of fine droplets of water by condensation of the steam in the gas. These droplets, which have a high latent heat of vaporization, vaporize upon contact with the jet, removing a much larger amount of heat from the jet than the gas does. Furthermore, these droplets which have thus been vaporized condense in contact either with the gas or with the cold wall of the cooling enclosure. This creates a movement of turbulence which favors agitation and therefore the exchange of heat between the cooling fluid and the jet.

This agitation is further promoted by providing a cooling system of known structure for the wall of the cooling enclosure extending along the jet to be cooled.

It would seem advantageous, in order to obtain perfect cooling of the wire, to use droplets coming into contact with the jet which have diameters at most equal to 2.5% of the diameter of the were produced. Thus, for a wire of a diameter of 200 82 m, it is recommended to use droplets of a diameter of at most 5 μm.

Since it is difficult to obtain a dispersion of droplets which satisfies this requirement by simple injection of the steam into the gas, one simple means of selecting the droplets consists in centrifuging the cooling fluid in the cooling enclosure in the following manner.

The cooling enclosure of the apparatus of the type in question is provided, in the portion thereof adjacent the nozzle, with a wall having the shape of a surface of revolution around an axis parallel to the axis of the nozzle from which the jet emerges. It is then sufficient to impart to the cooling fluid of the invention, by any known means, a movement of rotation around the axis of revolution of the wall. One may, for instance, employ a fan arranged near the wall and propelling the cooling fluid along an axis located at a distance other than zero from the axis of revolution of the wall. This distance is preferably at least equal to 50% of the distance between the axis of revolution and the wall.

The jet thus finds itself placed at a certain distance from the axis of revolution and is cooled by droplets whose diameter is less than the desired maximum, the centrifugal force impelling the droplets of excessively high diameter towards the wall of the cooling enclosure. Instead of using a fan, one can use the steam itself. For this purpose, it is advisable that at least one tube for delivering the steam into the cooling enclosure be arranged near the wall along an axis located at a distance other than zero from the axis of revolution of the wall. The steam as it expands in the gas then carries the entire cooling fluid along with it in a movement of rotation around the axis of revolution, thus bringing about the desired selecting of the droplets upon their formation.

Whatever the means employed to select the droplets, their cooling action is improved by suitably orienting the axis of propulsion of he cooling fluid.

Figure 2:
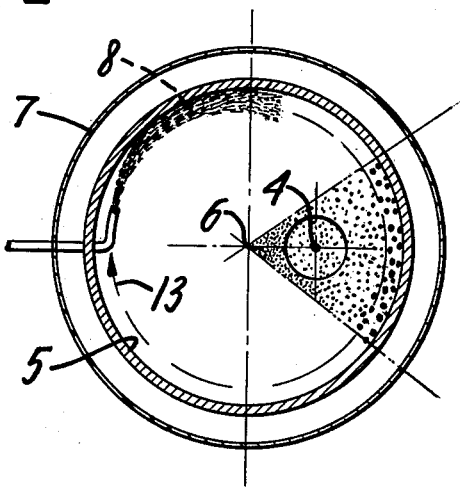

Several non-limitative embodiments of the invention are shown in the drawing, in which:

FIG. 1 is an elevational view in cross section through the portion of the cooling enclosure which is adjacent to the nozzle, and FIG. 2 is a plan view in cross section along the line II—II of FIG. 1 through the portion of the cooling enclosure.

In FIG. 1 there can be noted the portion 1 of a cooling enclosure (shown in part) adjacent the nozzle 2 having nozzle axis 3 from which the jet 4 of liquid metal emerges.

FIG. 2 shows that the inner wall 5 of the portion 1 has a circular cross section, so that the portion 1 has a cylindrical inner wall 5 around the axis of revolution 6 parallel to the axis 3 of the nozzle 2. The wall 5 is surrounded by a jacket 7 within which there flows a liquid having a temperature substantially less than the condensation point of the steam 8; this liquid enters into the jacket 7 via the inlet 9 and emerges from it via the outlet 10. The wall 5 is provided in accordance with the invention, with a gas feed tube 11 and a steam feed tube 12. The gas and the steam 8 mix together in the portion 1 of the cooling enclosure and are entrained in a movement of rotation 13 (FIG. 2) around the axis of revolution 6 of the cylindrical wall 5 by means of a fan 14 located near the wall 5 and whose axis is at a certain distance for the axis of revolution 6. The droplets coming from the introuction of the steam 8 into the gas which has a temperature less than the condensation point of the steam 8 and which furthermore is cooled by the wall 5 are subjected to centrifugation by the movement of rotation of the fluid. As can be noted from FIGS. 1 and 2, in which only one sector of the cooling fluid has been shown, the droplets of larger diameter are deposited on the wall 5, and the jet 4 is in contact with the droplets of smaller diameter.

In accordance with a variant (not shown), the fan 14 is eliminated and the expansion of the steam 8 in the cylinder 5 suffices to place the cooling fluid in rotation in accordance with the invention around the axis of revolution 6. For this purpose, the end of the steam feed tube 12 is located near the wall of the cylinder 5 so that the steam 8 is projected along an axis located at a certain distance from the axis of revolution 6 of the cylindrical wall 5.

Whatever the variant employed, the cooling of the jet 4 can be optimized bu furthermore seeing to it that the axis along which the cooling fluid is propelled forms an adjustable angle in space with the axis of revolution 6 of the wall 5.

Using the process described in U.S. Pat. No. 3,861,452, a jet 4 of liquid steel having a diameter of 75 μm was projected at a speed of 14 m per second into a cooling enclosure of a total length of 1.6 m, fed with a mixture of hydrogen and nitrogen (rate of flow: 25 liters/minute; temperature: 20° C.; hydrogen: 25%; nitrogen: 75%). The jet 4 which emerged from the nozzle 2 at a temperature of 1500° C. had a length of 0.42 m and the wire burned upon entering the ambient air, where it was at a temperature of about 1150° C.

When steam 8 is introduced in accordance with the invention (rate of flow: 0.05 kg/minute; temperature: 125° C.) into the portion 1 of the cooling enclosure which follows the nozzle 2, maintaining the same conditions as above for the feeding of hydrogen and nitrogen, the jet 4 had a length of 0.36 m and the wire entered into the ambient air at a temperature of about 940° C.

When, furthermore, this feed of steam 8 was used to rotate the cooling fluid in a cylinder of a diameter of 300 mm and a length of 350 mm which was adjacent to the nozzle 2, the axis of revolution 6 of the cylinder wall 5 being arranged parallel to and at a distance of 100 m from the axis of the nozzle 2, the jet 4 had a length of 0.28 m and the wire, free of traces of iron oxide or defects and breaks, entered into the ambient air at a temperature of 685° C. The axis of propulsion of the steam 8 which places the cooling fluid in rotation was located 140 mm from the axis of revolution 6 of the cylinder wall 5 and formed with it an angle of 30° opening in the direction towards the nozzle 2.

By replacing the hydrogen/nitrogen mixture by hydrogen (rate of flow: 25 liters/minute; temperature: 20° C.) in the same apparatus, a liquid jet 4 of a diameter of 165μm. had a length of 0.44 m. It arrived in the ambient air at 1150° C. and burned.

Upon adding steam 8 (rate of flow: 0.09 kg/minute; temperature: 125° C.), the jet 4 had a length of 0.38 m. The wire entered the ambient air at 950° C.

If the addition of steam 8 is employed in order to place the cooling fluid in rotation, the jet 4 had a length of 0.3 m. The wire entered the ambient air at a temperature of 700° C. It was free of traces of iron oxide, defects and breaks. The droplets which came into contact with the jet 4 had a diameter at most equal to about 5 μm.

Finally, it should be pointed out that the use of the cooling fluid in accordance with the invention is independent of the direction of the metal jet in space. Its use can be effected with a jet which is projected, for instance, vertically downward, horizontally, or vertically upward.

What is claimed is:

1. A cooling fluid for an apparatus for the manufacture of a solid wire by projecting a jet of liquid metal or metal alloy through a nozzle into a cooling enclosure containing the cooling fluid in which the transformation of the liquid jet into solid wire takes place, characterized by the fact that the cooling fluid consists of a mixture of a gas and steam, the gas and the steam being compatible with the jet, the gas furthermore being at a temperature below the condensation point of the steam, so as to transform at least a part of the steam into liquid droplets, said liquid droplets which enter into contact with the jet having diameters which at most equal to 2.5% of the diameter of the wire produced and being selected in suitable diameter by the centrifugation of the cooling fluid in the cooling enclosure.

2. The cooling fluid according to claim 1, characterized by the fact that the cooling fluid is imparted a movement of rotation in the portion of the cooling enclosure adjacent the nozzle, the wall of the adjacent portion having the shape of a surface of revolution around an axis parallel to the axis of the nozzle.

3. The cooling fluid according to claim 2, characterized by the fact that the cooling fluid is imparted a movement of rotation by means of a fan arranged near the wall of the adjacent portion for propelling the cooling fluid along an axis located at a distance other than zero from the axis of revolution of the wall.

4. The cooling fluid according to claim 2, characterized by the fact that the cooling fluid is imparted a movement of rotation by means of at least one steam delivery tube arranged near the wall of the adjacent portion for propelling the cooling fluid along an axis located at a distance other than zero from the axis of revolution of the wall.

5. The cooling fluid according to claim 3, characterized by the fact that the axis of propulsion of the cooling fluid and the axis of revolution of the wall form an angle which is adjustable in space.

6. An apparatus for the manufacture of a solid wire by projecting a jet of liquid metal or metal alloy through a nozzle into a cooling enclosure containing a cooling fluid in which the transformation of the liquid jet into solid wire takes place, said cooling fluid consisting of a mixture of a gas and steam, the gas and the steam being compatible with the jet, the gas furthermore being at a temperature below the condensation point of the steam, so as to transform at least a part of the steam into liquid droplets, characterized by the fact that the portion of the cooling enclosure adjacent the nozzle has a wall having the shape of a surface of revolution around an axis parallel to the axis of the nozzle and has means for imparting to the cooling fluid a movement of rotation around said axis of revolution, the gas feed being distinct from the steam feed.

7. The apparatus according to claim 6, characterized by the fact that said means consists of a fan arranged near the wall of the adjacent portion for propelling the cooling fluid along an axis located at a distance other than zero from the axis of revolution of the wall.

8. The apparatus according to claim 6, characterized by the fact that said means consists of at least one steam delivery tube arranged near the wall of the adjacent portion for propelling the cooling fluid along an axis located at a distance other than zero from the axis of revolution of the wall.

9. The apparatus according to claim 7, characterized by the fact that the axis of propulsion of the cooling fluid and the axis of revolution of the wall form an angle which is adjustable in space.

* * * * *

UNITED STATES PATENT AND TRADEMARK OFFICE

CERTIFICATE OF CORRECTION

PATENT NO. : 4,153,099

DATED : May 8, 1979

INVENTOR(S) : Bernard Pflieger et al

It is certified that error appears in the above-identified patent and that said Letters Patent are hereby corrected as shown below:

Col. 1, line 64, "were" should read -- wire --; line 65, "82 m" should read -- μm --. Col. 2, line 33, "he" should read -- the --; line 54, after "provided" insert a comma; line 60, "for" should read -- from --; line 62, "introuction" should read -- introduction --. Col. 3, line 13, "bu" should read -- by --; line 37, "100 m" should read -- 100 mm --.

Signed and Sealed this

*Fourth* Day of *September 1979*

[SEAL]

*Attest:*

*Attesting Officer*

LUTRELLE F. PARKER

*Acting Commissioner of Patents and Trademarks*